United States Patent [19]

Kawai et al.

[11] Patent Number: 4,522,177

[45] Date of Patent: Jun. 11, 1985

[54] TEMPERATURE COMPENSATED FUEL INJECTION SYSTEM FOR INTERNAL COMBUSTION ENGINES

[75] Inventors: Hisasi Kawai, Toyohashi; Toshikazu Ina, Aichi; Toshihiko Igashira, Toyokawa; Ken Nomura, Okazaki; Masakazu Yoshida, Toyota; Takao Komoda, Okazaki; Makio Hamanishi, Toyota, all of Japan

[73] Assignees: Nippon Soken, Inc., Nishio; Toyota Jidosha Kabushiki Kaisha, Toyota, both of Japan

[21] Appl. No.: 434,540

[22] Filed: Oct. 15, 1982

[30] Foreign Application Priority Data

Oct. 19, 1981 [JP] Japan ..... 56-165644
Oct. 19, 1981 [JP] Japan ..... 56-166713
Oct. 26, 1981 [JP] Japan ..... 56-170965

[51] Int. Cl.[3] ..... F02M 51/00

[52] U.S. Cl. ..... 123/478; 123/381; 123/491

[58] Field of Search ..... 123/381, 478, 491, 366, 123/368, 357

[56] References Cited

U.S. PATENT DOCUMENTS 3,392,630 7/1968 Schultz ..... 123/381
4,174,694 11/1979 Wessel et al. ..... 123/381
4,252,097 2/1981 Hartford et al. ..... 123/381
4,389,995 6/1983 Koide et al. ..... 123/491

FOREIGN PATENT DOCUMENTS 2523283 1/1976 Fed. Rep. of Germany ..... 123/381
2653942 6/1978 Fed. Rep. of Germany ..... 123/381
2073444 10/1981 United Kingdom ..... 123/368

*Primary Examiner*—Parshotam S. Lall
*Attorney, Agent, or Firm*—Cushman, Darby & Cushman

[57] ABSTRACT

An internal combustion engine fuel injection system includes a temperature sensor for detecting the temperature of the fuel or cooling water in the engine. When the detected temperature is higher than a given value, e.g., 50° C., a pressure regulator for controlling the pressure of fuel supplied to a fuel injection valve is controlled so as to increase the fuel pressure irrespective of the intake pipe negative pressure and thereby increase the quantity of fuel supplied to the engine. In the case of an electronically controlled fuel injection control system, a predetermined correction quantity corresponding to the detected temperature from the temperature sensor is added to the basic fuel injection quantity calculated in accordance with given operating parameters of the engine, thereby increasing the quantity of fuel supplied to the engine.

3 Claims, 12 Drawing Figures

TEMPERATURE COMPENSATED FUEL INJECTION SYSTEM FOR INTERNAL COMBUSTION ENGINES

BACKGROUND OF THE INVENTION

1. Field of the Invention

This invention relates to fuel injection systems for internal combustion engines and more particularly to a fuel injection system equipped with temperature compensating means.

2. Description of the Prior Art

With the fuel injection valve of a fuel injection system in an internal combustion engine, if the fuel temperature rises particularly under the high intake pipe vacuum conditions, there is the danger of causing a vacuum boiling phenomenon at the orifice of the fuel injection valve and thus failing to supply the desired amount of fuel. As a result, when the external temperature is high, the idling operation becomes unstable and there is the danger of the engine stalling in extreme cases.

With the recent fuel injection systems for internal combustion engines, a method is used in which the concentration of oxygen in the exhaust gases from an engine is detected and fed back to the fuel supply system thereby controlling the duration of opening of the fuel injection valve to provide the correct air-fuel ratio and thus the occurrence of the above-mentioned troubles is on the decrease. However, under conditions where the $O_2$ sensor which is generally used for detecting the oxygen content of the exhaust gases is not operated, e.g., where the exhaust gas temperature is low, these troubles still tend to occur.

The phenomenon in which the quantity of fuel injected from the fuel injection valve decreases with rise in the fuel temperature will now be explained with reference to the experimental results shown in FIG. 1 of the accompanying drawings. In the Figure, the abscissa represents the fuel temperatures (° C.) and the ordinate represents the rates of decrease of the fuel injection quantity at the different fuel temperatures, expressed as percentages, with the fuel injection quantity at a fuel temperature of 20° C. being taken as 1.

Where gasoline is injected for a given time into the intake pipe of an engine through an electromagnetic fuel injection valve, if the fuel temperature rises from 20° C. to 60° C. when the vacuum in the intake pipe is 500 mmHg, the fuel quantity decreases by as much as 10%. When the intake pipe vacuum decreases so that it comes near to the atmospheric pressure, the rate of fuel decrease with rise in the fuel temperature decreases gradually as the vacuum changes to 420, 360 and 120 mmHg, respectively. Under high load operating conditions where the intake pipe vacuum is below 120 mmHg, there is practically no danger of troubles. The danger of troubles increases when the intake vacuum is near to 500 mmHg and the air-fuel ratio set to about 14:1 at 20° C. leans out to about 16:1 at 60° C. Presently, it is difficult to operate the engine at air-fuel ratios greater than 15:1 under idling conditions and the engine inevitably operates unstably.

On the other hand, when an engine equipped with a carburetor or electronically controlled fuel injection system (EFI) is started again under high temperature conditions, in the fuel supply pipe, the carburetor float chamber or in the injectors of the EFI system the density of the fuel is sometimes decreased by the high temperature and also the fuel is partially vaporized with the resulting further decrease in the density, thereby causing a phenomenon where the air-fuel mixture supplied to the engine is made leaner than is desired. This gives rise to a problem that the restarting performance is deteriorated and the engine idles unstably thus increasing the danger of the engine stalling.

Another problem is that with the exhaust emission regulations becoming severer in recent years, the idling air-fuel ratio is set as lean as possible and thus the danger of the engine stalling is increased further.

SUMMARY OF THE INVENTION

It is a primary object of this invention to provide a fuel injection system having fuel injection valve means, which is capable of ensuring stable engine operating conditions even at high fuel temperatures.

Thus, in accordance with the invention the fuel temperature is detected so that the differential pressure between the fuel pressure and the intake pipe negative pressure is maintained at a given value by a pressure regulator when the fuel temperature is below a given value, e.g., 50° C. and the preset fuel pressure of the pressure regulator is adjusted higher irrespective of the intake pipe negative pressure when the fuel temperature exceeds the given value.

It is another object of the invention to improve the restarting performance of an engine and enhance the stability of the idling operation on the basis of a concept that the temperature of fuel in an electronically controlled fuel injection system (EFI) of an engine is detected so that if the fuel temperature is excessively high the duration of fuel injection is increased and the fuel quantity is corrected in a direction to increase.

Thus, in accordance with the invention the output value of a fuel temperature sensor positioned near the electromagnetic fuel injection valve is utilized to determine a correction value for a basic fuel injection quantity predetermined in accordance with an intake air quantity or intake pipe negative pressure and an engine speed and the basic fuel injection quantity is corrected by using the determined correction value.

It is still another object of the invention to provide a fuel supply system which ensures a stable idling operation even when the engine is started under high temperature conditions.

Thus, in accordance with the invention the fuel temperature or the cooling water temperature is detected so that if the temperature is higher than a value associated with the occurrence of an unstable engine operation, e.g., engine stalling, only during a given time period just after the starting a fuel metering mechanism is adjusted in a direction to increase the fuel quantity so as to prevent the air-fuel mixture or the injected fuel from becoming leaner and thereby stabilize the idling operation just after the start of the engine.

In other words, in the case of a fuel supply system employing a carburetor, an electromagnetic on-off valve for controlling the opening and closing of an opening of an air bleed leading to a manual adjusting screw is positioned in a slow system or circuit for supplying the fuel from a float chamber to the carburetor downstream of a throttle valve through an idle port, so that when the detected temperature of the fuel or the cooling water indicates a high temperature exceeding a given reference value, the air bleed is closed for a given time period by a control signal from a control circuit through the electromagnetic on-off valve and the air-fuel mixture is enriched thereby increasing the fuel supply quantity.

In the case of a fuel supply system of the type using an electronically controlled fuel injection unit, if the temperature of the fuel or the cooling water exceeds a given reference value indicative of a high temperature condition, a control circuit applies to the fuel injection unit a control signal which is corrected for enrichment with respect to a basic fuel injection quantity (injection time) computed from engine operating parameters in accordance with a predetermined enrichment rate characteristic.

As a result, under high temperature conditions, even if the density of the fuel in the fuel system of an engine is decreased or the ordinary idling air-fuel ratio is set to one which is as lean as possible but still ensures idling, under such high temperature conditions the fuel supply is increased suitably for a given period of time after the start of the engine, thereby preventing the engine from stalling and stabilizing the idling operation.

DESCRIPTION OF THE PREFERRED EMBODIMENTS

Figure 1:
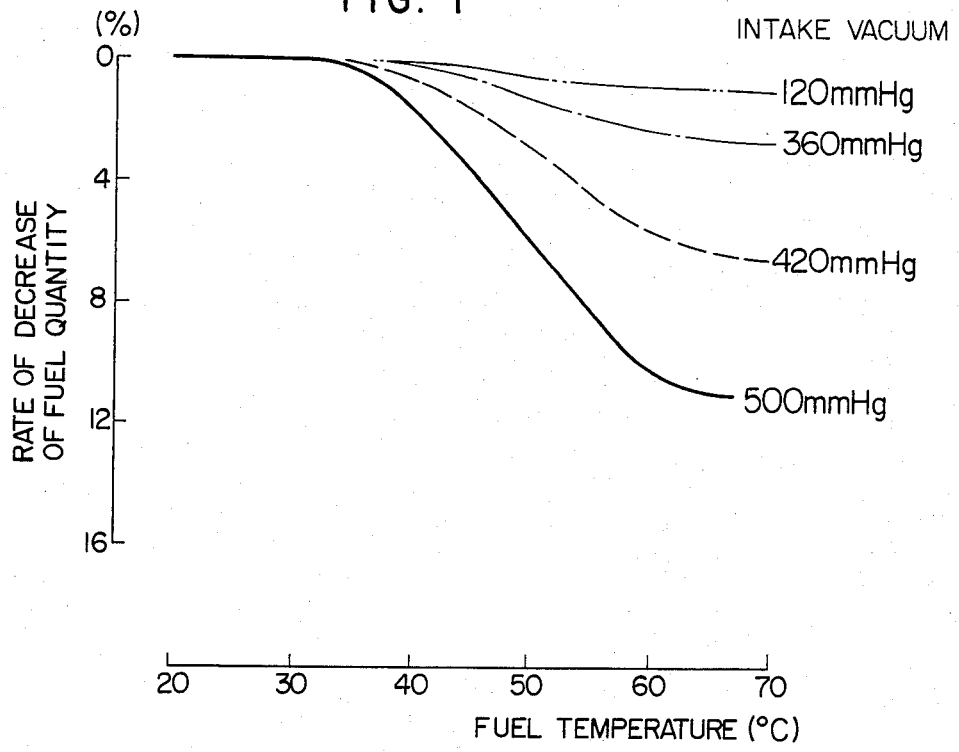
FIG. 1 is a graph showing the manner in which the quantity of fuel injected varies with the fuel temperature.
Figure 2:
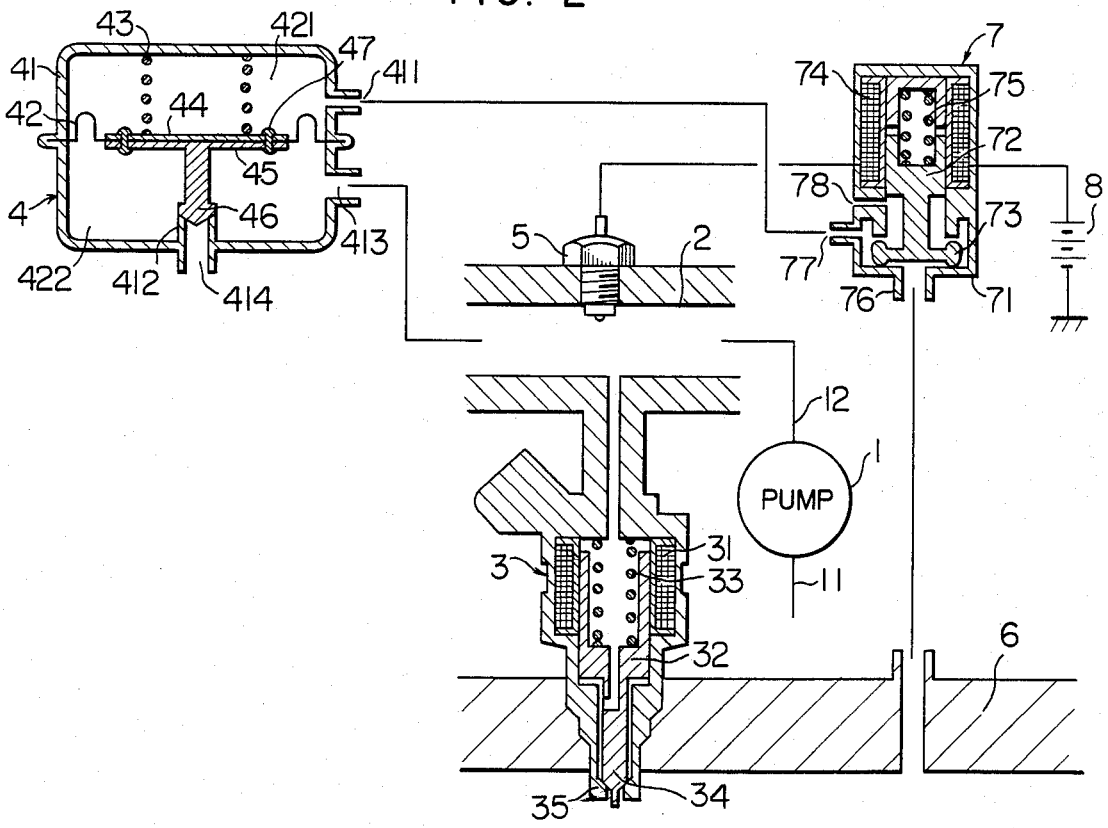
FIG. 2 is a schematic diagram showing a first embodiment of a fuel injection system according to the invention.

The present invention will now be described with reference to the first embodiment shown in FIG. 2.

In the Figure, numeral 1 designates a fuel pump which functions to introduce the fuel from a fuel tank (not shown) through its inlet part 11 and force the fuel into a fuel pipe 2 through its outlet port 12.

Fitted into the fuel pipe 2 are a fuel injection valve 3, a pressure regulator 4 and a temperature switch 5. A part of the fuel forced into the fuel pipe 2 is injected into an intake pipe 6 through the fuel injection valve 3 and the remainder is returned to the fuel tank via the pressure regulator 4.

The fuel injection valve 3 comprises a plunger 32, a solenoid 31 mounted on the outer surface of the plunger 32, a spring 33 for biasing the plunger 32, a needle 34 formed on the forward end portion of the plunger 32, and a valve seat 35 which forms, along with the needle 34, a fuel injection orifice, and the fuel injection orifice is opened into the intake pipe 6. When the solenoid 31 is energized by a signal from a computer, the plunger 32 is shifted upwardly against the spring 33 and the fuel is injected into the intake pipe 6 through the gap between the needle 34 and the valve seat 35.

The pressure regulator 4 comprises mainly a casing 41, a diaphragm 42, a spring 43, a spring retainer 44, a valve retainer 45, a valve 46 and rivets 47.

The diaphragm 42 divides the inside of the casing 41 into upper and lower parts so that first and second diaphragm chambers 421 and 422 are respectively formed in the upper and lower parts. The atmospheric pipe or the negative pressure in the intake pressure 6 is introduced into the first diaphragm chamber 421 through a port 411 formed in the casing 41. The fuel is introduced from the fuel pipe 2 into the second diaphragm chamber 422 through a port 413 formed in the casing 41. The spring retainer 44 and the valve retainer 45 are respectively arranged on the central upper and lower surfaces of the diaphragm 42 and they are fastened together by the rivets 47 with the diaphragm 42 held therebetween. The spring 43 mounted in the first diaphragm chamber 421 presses the diaphragm 42 downward through the spring retainer 44. The valve 46 is projected downward from the valve retainer 45 within the second diaphragm chamber 422, thereby opening and closing a valve seat 412 formed at an opening 414 which is formed in the casing 41 and communicating with the fuel tank. As a result, the fuel introduced into the second diaphragm chamber 422 is returned to the fuel tank and the fuel pressure in the second diaphragm chamber 422 is regulated.

The fuel pressure is determined by the biasing force of the spring 43 itself and the pressure in the first diaphragm chamber 421. The biasing force of the spring 43 is selected such that when the differential pressure between the first and second diaphragm chambers 421 and 422 exceeds 2.5 $kg/cm^2$, for example, the diaphragm 42 is displaced in the direction of the first diaphragm chamber 421 and thus the valve 46 is separated from the valve seat 412, thereby opening the valve.

The introduction of the negative pressure from the intake pipe 6 into the first diaphragm chamber 421 of the pressure regulator 4 is effected by means of a negative pressure change-over valve 7. The negative pressure change-over valve 7 is a solenoid type three-way valve and it comprises a casing 71, a plunger 72, a valve member 73 formed at the forward end of the plunger 72, a solenoid 74 mounted on the outer surface of the plunger 72, a spring 75 for biasing the plunger 72 and openings 76, 77 and 78 formed at three positions in the casing 71. The opening 76 is communicated with the intake pipe 6, the opening 77 with the first diaphragm chamber 421 of the pressure regulator 4 and the opening 78 with the atmosphere. When the solenoid 74 is not energized, the valve member 73 closes the opening 76 by the biasing force of the spring 75 thereby communicating the openings 77 and 78 with each other. When the solenoid 74 is energized, the valve member 73 is shifted upward against the spring 75 so that the openings 77 and 78 are disconnected and the openings 76 and 77 are communicated with each other. The current to the solenoid 74 is supplied from a battery 8 and is grounded to the fuel pipe 2 through the temperature switch 5.

The purpose of the temperature switch 5 is to detect the temperature of the fuel in the fuel pipe 2 and it operates to close when the fuel temperature is lower than a given value, e.g., 50° C. and open when the fuel temperature is higher than 50° C.

With the fuel injection system constructed as described above, when the fuel temperature in the fuel pipe 2 is lower than 50° C., the temperature switch 5 is closed so that the solenoid 74 of the negative pressure change-over valve 7 is energized and the valve member 74 communicates the openings 76 and 77 with each other and thus the negative pressure in the intake pipe 6 is introduced into the first diaphragm chamber 421 of the pressure regulator 4. Since the pressure regulator 4 controls the differential pressure between the fuel pressure in the fuel pipe 2 communicating with the second diaphragm chamber 422 and the pressure in the intake pipe 6 at 2.5 kg/cm$^2$, the fuel injection valve 3 injects the fuel into the intake pipe 6 at the differential pressure of 2.5 kg/cm$^2$.

When the fuel temperature in the fuel pipe 2 exceeds 50° C., the temperature switch 5 closes and thus the solenoid 74 of the negative pressure change-over valve 7 is deenergized. As a result, the valve member 73 closes the opening 76 and communicates the openings 77 and 78 with each other and consequently the atmospheric pressure is introduced into the first diaphragm chamber 421 of the pressure regulator 4. Since the pressure regulator 4 controls the differential pressure between the atmospheric pressure and the fuel pressure at 2.5 kg/cm$^2$, the fuel injection valve 3 injects the fuel into the intake pipe 6 at the differential pressure of 2.5 kg/cm$^2$ with respect to the atmospheric pressure irrespective of the pressure in the intake pipe 6. As a result, if the negative pressure in the intake pipe 6 is 500 mmHg (0.675 kg/cm$^2$), for example, the fuel is injected at a differential pressure of 3.175 kg/cm$^2$ and thus the fuel quantity is increased by 13% as compared with the quantity of fuel injected at the differential pressure of 2.5 kg/cm$^2$ under low fuel temperature conditions.

While, in the above-described embodiment, the control of the negative pressure change-over valve 7 is effected as a two-step control by means of the temperature switch 5, it is possible to use a linear solenoid for the solenoid 74 and control it by means of a computer, thereby continuously changing the position of the valve member 73 to those corresponding to the fuel temperatures. By so doing, the negative pressure introduced into the first diaphragm chamber 421 of the pressure regulator 4 can be suitably weakened with the atmospheric pressure thereby controlling the preset pressure of the pressure regulator 4 in a continuous manner.

As described hereinabove, in accordance with the internal combustion engine fuel injection system of this invention, the fuel temperature in the fuel supply passage is detected so that when the fuel temperature is higher than a given value, the preset pressure of the pressure regulator is increased and a decrease in the fuel injection quantity due to a rise in the fuel temperature is compensated for, thereby preventing the idling operation of the engine from becoming unstable under high fuel temperature conditions. Further, in accordance with the invention the introduction of the intake pipe negative pressure into the pressure regulator is limited or cut off as a means of increasing the preset pressure of the pressure regulator with the result that not only the preset pressure of the pressure regulator is increased under low load operating conditions of the engine where temperature compensation is required, but also the provision of any undesired compensation is prevented under high load operating conditions thereby preventing the fuel from being supplied excessively.

Figure 3:
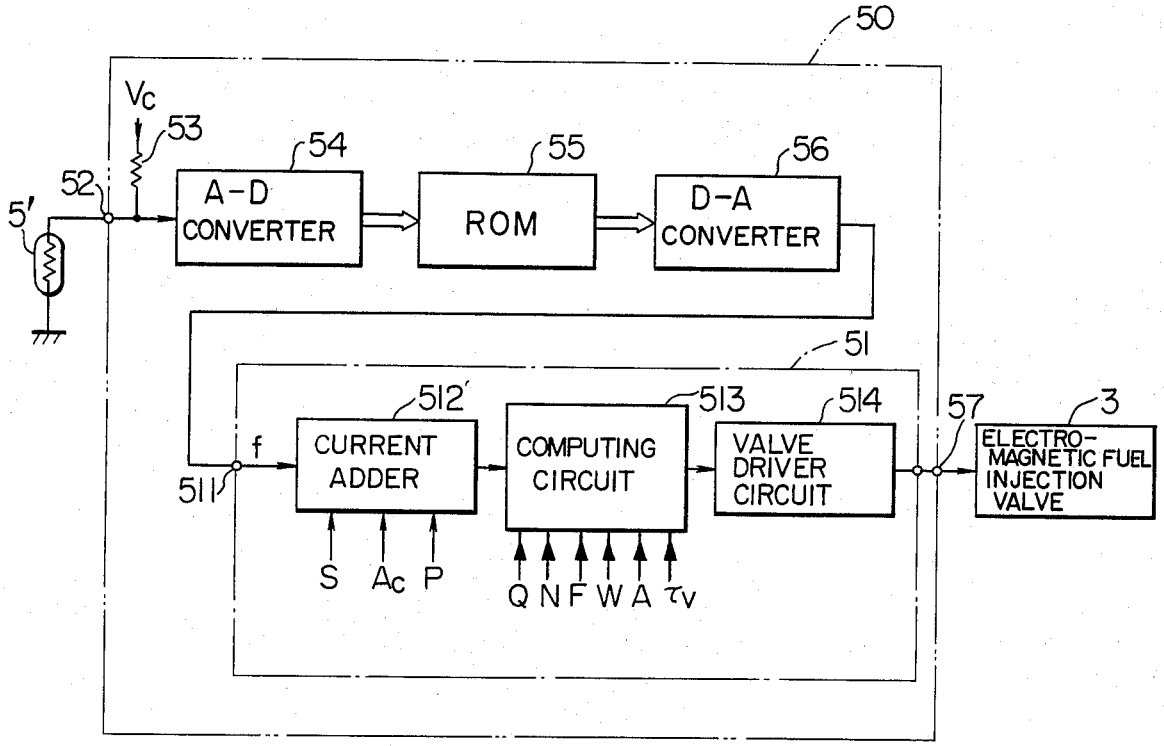
FIG. 3 is a block diagram showing a fuel injection control system forming a second embodiment of the invention.

FIG. 3 shows a circuit diagram for a second embodiment of the invention which is applied to an electronically controlled fuel injection control. One end of a fuel temperature sensor 5' is connected to an input terminal 52 of a control circuit 50. The other end of the fuel temperature sensor 5' is grounded. An output terminal 57 is connected to an electromagnetic valve 3. On the other hand, the input terminal 52 is connected to one end of a resistor 53 and the input of an 8-bit A-D converter 54. A constant voltage $V_c$ is applied to the other end of the resistor 53. The A-D converter 54 has its binary code output connected to an ROM 55. The output of the ROM 55 is connected to the input of a D-A converter 56 comprising an R-2R type resistor network. The output of the D-A converter 56 is connected to the f signal input of a current adder 512 in a main control circuit 51. The current adder 512 converts the voltages of after-start enrichment S, acceleration enrichment $A_c$ and power enrichment P to currents and adds the same together. The output of the current adder 51 is connected to the input of a computing circuit 513. The computing circuit 513 receives, in addition to the signal from the current adder 512, an intake air quantity Q, an engine speed N, a feedback correction value F, a water temperature correction W, an air temperature correction A and a dead injection time $\tau_v$ which are not shown and performs the computation of the following equation (1) thereby generating a fuel injection time or pulse width $\tau_{(1)}$ at its output $$\tau_{(1)}=Q/N\times F\times W\times A\times(1+S+A_c+P+f)+\tau_v \qquad (1)$$

Here, $\tau_{(1)}$ is a fuel injection time and $K=1+S+A_c+P+f$ is an enrichment rate.

Numeral 514 designates an electromagnetic valve driver circuit by which the output of the computing circuit 513 is power amplified and outputted. The output of the electromagnetic valve driver circuit 514 is connected to the output terminal 57 of the control circuit 50. The main control circuit 51 is well known in the art.

Figure 4:
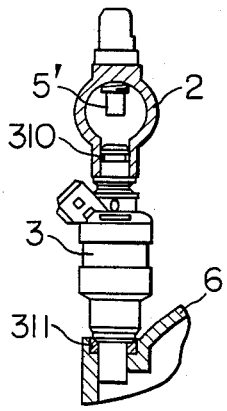
FIG. 4 shows the construction of the electromagnetic fuel injection valve in the system of FIG. 3.

FIG. 4 shows the mounting structure of the fuel temperature sensor 5' in the system of FIG. 3. Numeral 6 designates an intake pipe and the injecting portion of the electromagnetic fuel injection valve 3 (hereinafter referred to as an electromagnetic valve) is fitted into the intake pipe 6 through a rubber collar 311. Numeral 310 designates an O-ring, and 2 a fuel pipe whose sectional structure is shown in FIG. 4. Numeral 5' designates the fuel temperature sensor screwed into the fuel pipe 2. The fuel temperature sensor 5' is fitted in the fuel pipe 2 near one of a plurality of the electromagnetic valves which attains the highest temperature.

The operation of the system of FIG. 3 will now be described.

In FIG. 3, the enrichment rates are used as correction values for the basic injection quantities predetermined in accordance with the intake air quantities or intake pressures and the engine speeds. The fuel temperature sensor 5' comprises a thermistor whose resistance value decreases as the fuel temperature increases. Thus, the voltage at the input terminal of the control circuit 50 is decreased with an increase in the fuel temperature. The A-D converter 54 converts this voltage to a digital quantity in binary code form. The fuel temperature indicative digital output provides an address for the ROM 55. The ROM 55 generates an enrichment rate corresponding to the fuel temperature.

Figure 6:
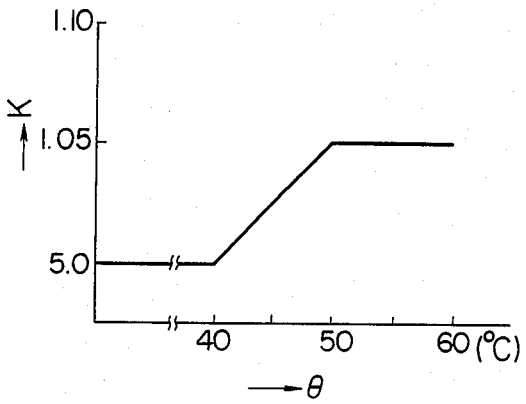
FIG. 6 is a graph showing the relationship between the fuel temperature and the enrichment rate in the system of FIG. 3.

The relationship between the fuel temperature and the enrichment rate is shown in FIG. 6. In the Figure, the abscissa represents the fuel temperature and the ordinate represents the enrichment factor K. The D-A converter 56 converts the digital output of the ROM 55 to an analog voltage and applies it to the f input of the current adder 512 in the main control circuit 51. The main control circuit 51 performs the computation of the equation (1) as mentioned previously and controls the electromagnetic valve 3.

In the above-described embodiment, the computing circuit 51 is an analog computational control circuit. If the computing circuit comprises a microcomputer, the A-D converter 54 and the ROM 55 may be respectively used as the internal A-D converter and ROM of the microcomputer and the D-A converter 56 may be eliminated.

Figure 5:
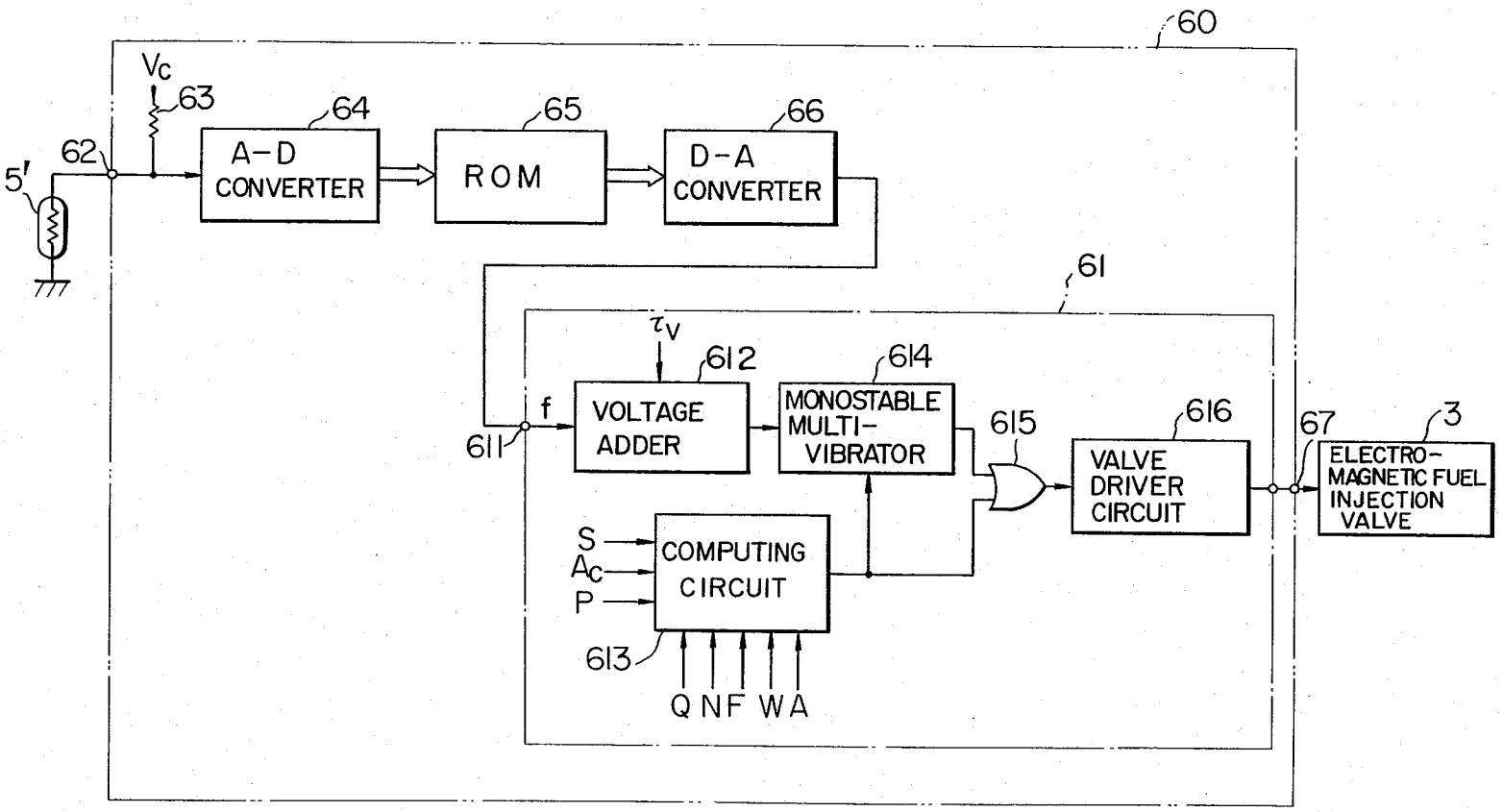
FIG. 5 is a block diagram showing a fuel injection control system forming a third embodiment of the invention.

Referring to FIG. 5, there is illustrated a circuit diagram for a system forming a third embodiment of the invention and performing an electronically controlled fuel injection control method. An input terminal 62 of a control circuit 60 is connected to one end of a fuel temperature sensor 5'. The other end of the fuel temperature sensor 5' is grounded. An output terminal 67 is connected to an electromagnetic valve 3.

On the other hand, the input terminal 62 is connected to one end of a resistor 63 and the input of an 8-bit A-D converter 64. A constant voltage $V_c$ is applied to the other end of the resistor 63. The A-D converter 64 has its binary code output connected to an ROM 65. The output of the ROM 65 is connected to the input of a D-A converter 66. The output of the D-A converter 66 is connected to the f signal input of a voltage adder 612 in a main control circuit 61. The voltage adder 612 adds the voltage of the f signal and that of a dead injection time $W_v$ together and applies the resulting sum to a monostable multivibrator 614. The monostable multivibrator 614 is triggered by the trailing edge of a pulse width signal from a computing circuit 613 that will be described later and generates a pulse width $\tau_{(3)}$ corresponding to the voltage from the voltage adder 612. The monostable multivibrator 614 is connected to one input of an OR gate 615.

The computing circuit 613 receives the signals indicative of intake air quantity Q, engine speed N, feedback correction value F, water temperature correction W, air temperature correction A, after-start enrichment S, acceleration enrichment $A_c$ and power enrichment P and performs the computation of the following equation (2), thereby generating a pulse width $\tau_{(2)}$ $$\tau_{(2)}=Q/N\times F\times W\times A\times(1+S+A_c+P) \quad (2)$$

The output of the computing circuit 613 is connected to the monostable multivibrator 614 and the other input of the OR gate 615. The output of the OR gate 615 is connected to the input of an electromagnetic valve driver circuit 616. The output of the electromagnetic valve driver circuit 616 is connected to the output terminal 67 of the control circuit 60.

The resistor 63, the A-D converter 64, the D-A converter 66 and the electromagnetic valve driver circuit 616 are identical in circuit construction and operation with the resistor 53, the A-D converter 54, the D-A converter 56 and the electromagnetic valve driver circuit 514 in the system of FIG. 3.

The system of FIG. 5 operates as follows.

Figure 7:
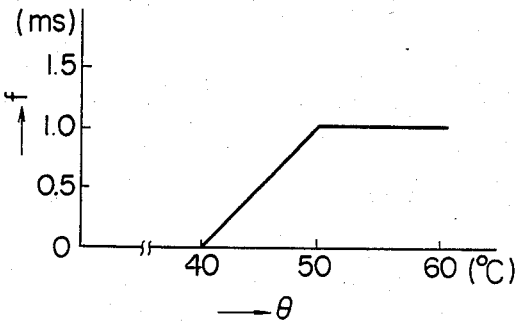
FIG. 7 is a graph showing the data stored in the ROM in the third embodiment of the invention.

In FIG. 5, the injection enrichment values are used as correction values for the basic fuel injection quantities predetermined in accordance with the intake air quantities or intake pipe pressures and the engine speeds. As shown in FIG. 7, the injection enrichment values f in relation to the fuel temperatures $\theta$ are preprogrammed into the ROM 65. In FIG. 7, the abscissa represents the fuel temperature $\theta$ and the ordinate represents the injection enrichment value f. The D-A converter 66 converts the digital output of the ROM 65 to an analog voltage and applies it to the f signal input of the voltage adder 612 in the main control circuit 61. The main control circuit 61 performs, as mentioned previously, the computation of the equation (2) generating a pulse width $\tau_{(2)}$ and then adds the pulse widths of the output $\tau_{(3)}$ from the monostable multivibrator 614 and the output $\tau_{(2)}$ together through the OR gate 615 thereby performing the computation of the following equation $$\tau_{(4)}=Q/N\times F\times W\times A\times(1+S+A_c+P)+\tau_v+f \quad (3)$$

The electromagnetic valve driver circuit 616 power amplifies the pulse width $\tau_{(4)}$ and operates the electromagnetic valve 3.

While, in the system of FIG. 5, the computations are performed by the voltage adder 612, the monostable multivibrator 614 and the computing circuit 613 which are each comprised of an analog circuit, the computations may be performed by means of a microcomputer. In this case, the OR gate 615 is not necessary. Also, the A-D converter 64 and the ROM 65 of FIG. 5 may be respectively used as the internal A-D converter and ROM of the microcomputer and the D-A converter 66 may be eliminated. Further, while, in the systems shown in FIGS. 3 and 5, the output voltage of the fuel temperature sensor 5' is subjected to A-D conversion so that a digital quantity is determined in accordance with the characteristic stored in the ROM and the digital quantity is converted again to an analog voltage by D-A conversion, the necessary arrangement may be comprised of analog circuits depending on the characteristic stored.

Further, while, the systems of FIGS. 3 and 5 each comprises an EFI system in which the basic injection quantity is determined in accordance with the intake air quantity and the engine speed and various corrections are made to the basic injection quantity, this may be replaced with another EFI system in which a basic injection quantity is determined in accordance with the intake pipe pressure and the engine speed and the necessary corrections are made to the basic injection quantity.

In accordance with the invention, the correct air-fuel ratio mixtures can be produced under high temperature conditions, thus improving the restarting performance and the stability of idling operation of an engine.

Figure 8:
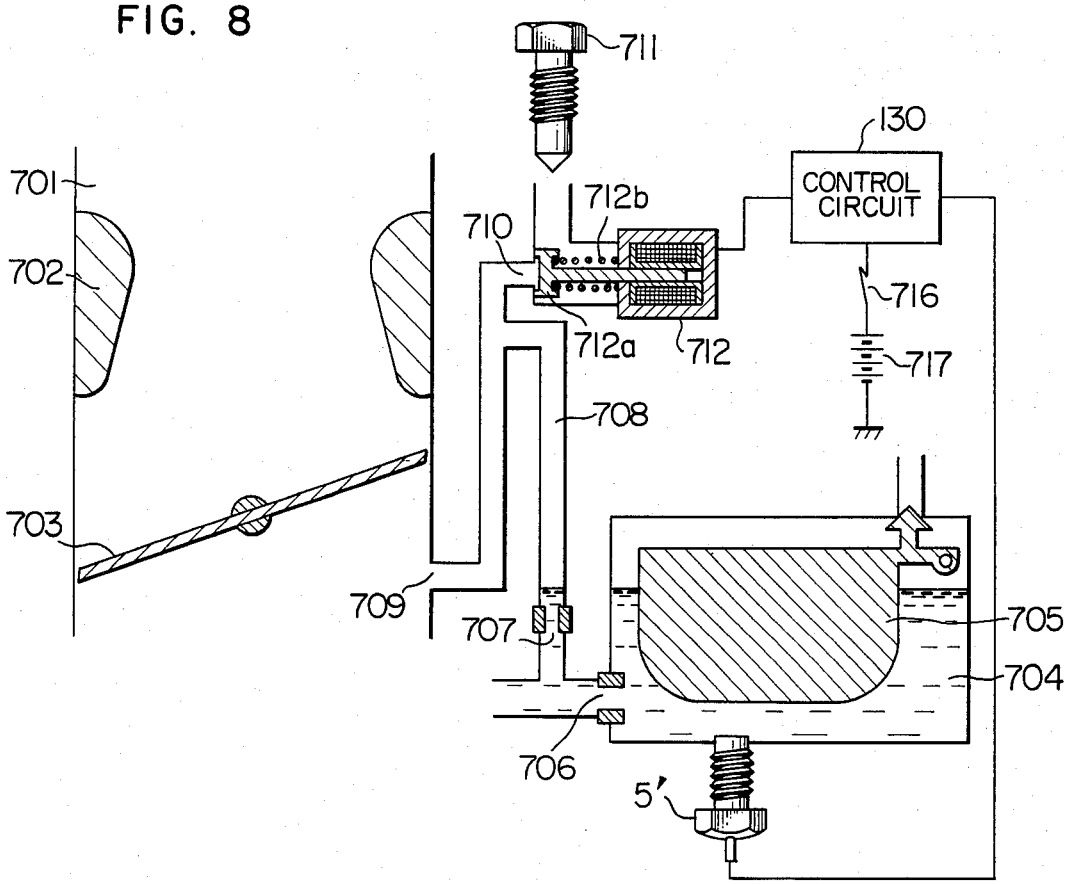
FIG. 8 is a schematic diagram showing the construction of a fourth embodiment of the invention.

A fourth embodiment of the invention will now be described with reference to FIG. 8. In the Figure showing a fuel supply system employing a carburetor, numeral 701 designates a carburetor of the known type comprising a venturi 702, a throttle valve 703 and a float chamber 704. While the fuel circuits of the carburetor 701 comprise a main circuit, a power circuit, a slow circuit, etc., FIG. 8 illustrates only the slow circuit and the other circuits are omitted. A float 705 is positioned in the float chamber 704 so as to maintain constant the fuel level in the float chamber 704. While the fuel in the float chamber 704 flows to the main circuit through a main jet 706, a part of the fuel is branched to a slow circuit 708 by way of a slow jet 707. The fuel in the slow circuit 708 is discharged through an idle port 709 or an opening just below the throttle valve 703. Note that an air bleed 710 with a manual adjusting screw 711 is positioned in the slow circuit 708 so that the fuel discharged from the idle port 709 is suitably mixed with air in the slow circuit 708 before it is discharged.

With the construction described above, an electromagnetic on-off valve 712 is positioned in the opening of the air bleed 710 leading to the manual adjusting screw 711 so as to control the opening and closing thereof and thereby provide an enriching correction for starting the engine at high temperatures, and the electromagnetic on-off valve 712 is operated by the control signal from a control circuit 130. In other words, when energized by the control signal, a valve member 712*a* is attracted by a solenoid and the opening of the air bleed 710 is opened. When the current flow is cut off, the opening is closed by the force of a spring 712*b*.

Figure 9:
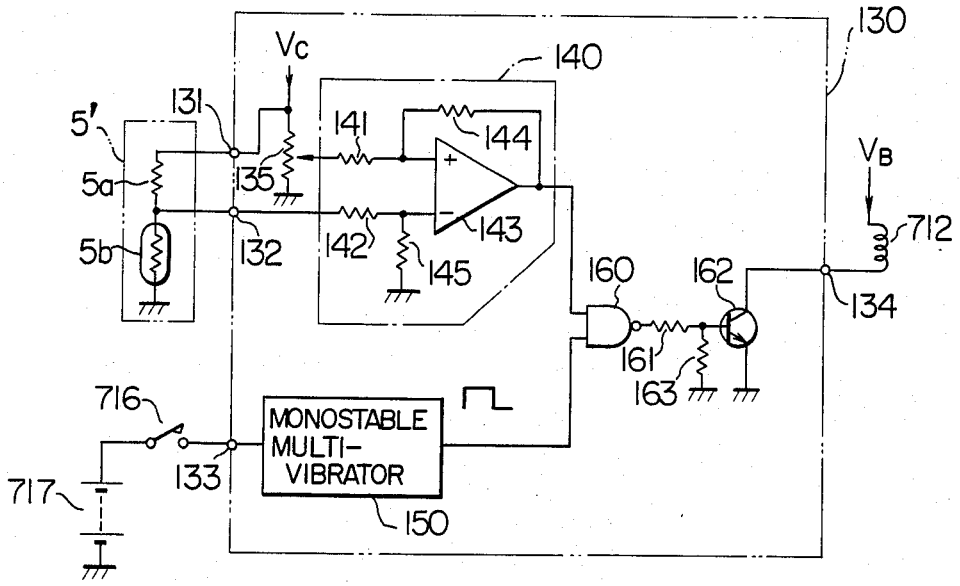
FIG. 9 is a circuit diagram showing the construction of the control circuit 130 in FIG. 8.

The construction of the control circuit 130 is shown in FIG. 9. A fuel temperature sensor 5' is fitted into the float chamber 704 and it comprises a resistor 5*a* and a thermistor 5*b* and the resistor 5*a* has its one end connected to an input terminal 131 of the control circuit 130 and the other end connected to one end of the thermistor 5*b*. The other end of the thermistor 5*b* is grounded. The junction point of the resistor 5*a* and the thermistor 5*b* is connected to an input terminal 132 of the control circuit 130.

A key switch 716 has its one end connected to the positive terminal of a battery 717 and the other end connected to an input terminal 133 of the control circuit 130. The negative terminal of the battery 717 is grounded. An output terminal 134 of the control circuit 130 is connected to one end of the coil of the electromagnetic on-off valve 712 and the voltage $V_B$ from the battery 717 is applied to the other end of the coil.

A constant voltage $V_c$ is applied to the input terminal 131. The constant voltage $V_c$ is also applied to one end of the fixed terminal of a variable resistor 135 and the other end of the fixed terminal is grounded. The variable terminal of the variable resistor 135 is connected to the noninverting input of an operational amplifier 143 through a resistor 141. The input terminal 132 is connected to the inverting input of the operational amplifier 143 through a resistor 142. A resistor 144 is connected as a positive feedback resistor between the noninverting input and the output of the operational amplifier 143. A resistor 145 is connected between the inverting input of the operational amplifier 143 and the ground. The resistors 141, 142, 144 and 145 and the operational amplifier 143 form a voltage comparator 140. The output of the comparator 140 is connected to one input of a NAND gate 160. The input terminal 133 is connected to the input of a monostable multivibrator 150. The output of the monostable multivibrator 150 is connected to the other input of the NAND gate 160. The output of the NAND gate 160 is connected to the base of a transistor 162 through a resistor 161 and the transistor 162 has its emitter connected to the ground and its collector connected to the coil of the on-off valve 712 through the output terminal 134 of the control circuit 130. A resistor 163 is grounded between the base of the transistor 162 and the ground.

With the construction described above, the operation of the control circuit 130 will now be described.

When the fuel temperature rises, the resistance value of the thermistor 5*b* decreases and thus the output voltage of the fuel temperature sensor 5' decreases. When the output voltage drops below a preset voltage $V_r$ of the variable resistor 135, the output of the comparator 140 goes to a high level. When the output voltage of the fuel temperature sensor 5' becomes higher than the preset voltage $V_r$, the output of the comparator 140 goes to a low level. The preset voltage $V_r$ is one corresponding to a fuel temperature of 60° C. indicative of a high temperature.

When the key switch 716 is turned on to start the engine, the monostable multivibrator 150 comes into operation and its output goes to the high level. The output remains at the high level for a given period, e.g., 10 seconds, and then it goes to the low level.

When the two inputs of the NAND gate 160 both go to the high level, the NAND gate 160 generates a low level signal at its output. As a result, when the two conditions, i.e., that the fuel temperature is higher than 60° C. and that the time elapsed after the closing of the key switch 716 is less than 10 seconds are met, the output of the NAND gate 160 goes to the low level. Otherwise, the output of the NAND gate 160 goes to the high level. When the output of the NAND gate 160 goes to the high level, the transistor 162 is turned on and it generates a control signal for opening the electromagnetic on-off valve 712. When the output of the NAND gate 160 goes to the low level, the transistor 162 is turned off and it generates a control signal for closing the electromagnetic on-off valve 712.

When the engine is to be started under the normal conditions, the temperature of the fuel in the float chamber 704 is lower than 60° C. In this condition, if the key switch 716 is turned on, the control circuit 130 detects through the fuel temperature sensor 5' that the fuel temperature is lower than 60° C. and the electromagnetic on-off valve 712 is immediately energized thereby opening it. As a result, the fuel discharged from the idle port 709 is mixed with the air introduced preliminarily from the air bleed 710 through the adjusting screw 711 and thus the air-fuel ratio of the mixture attains a predetermined relatively lean ratio.

When the engine is started again under high external temperature conditions, there are cases where the temperature of the fuel in the float chamber 704 is higher than 60° C. so that the density of the fuel is decreased and the density is further decreased by the production of emulsion due to a partial vaporization of the fuel. In such a case, if the key switch 716 is turned on to start the engine, the control circuit 130 detects through the fuel temperature sensor 5' that the fuel temperature is higher than 60° C. and the energization of the electromagnetic on-off valve 712 is delayed by 10 seconds during which the opening of the air bleed 710 is closed. After the expiration of 10 seconds, the on-off valve 712 is energized and opened. As a result, the fuel issuing from the idle port 709 during the 10-second period is not mixed with the air introduced from the air bleed 710 and thus the mixture is enriched considerably as compared with the case where the fuel is mixed with the air.

However, since the fuel density has already decreased, the enrichment results in the correct fuel quantity so that the engine is started easily and the idling after the start is stabilized. At the expiration of 10 seconds after the closing of the key switch 716, the control circuit 130 energizes the on-off valve 712 to open it. While this stops the fuel enrichment by the fuel issuing from the idle port 709, during this period of the float chamber 704 is supplied with fresh fuel which is low in temperature and involving no production of emulsion due to vaporization, thus giving rise to no difficulty.

While, in the embodiment described above, the length of the fuel enrichment period is fixed, the period may be increased in proportion to the fuel temperature.

Further, while the fuel temperature is detected, the engine cooling water temperature may be detected since there is a close relation between the fuel temperature and the cooling water temperature when the engine is at rest. In this case, there is no need to modify the construction of the control circuit.

Figure 10:
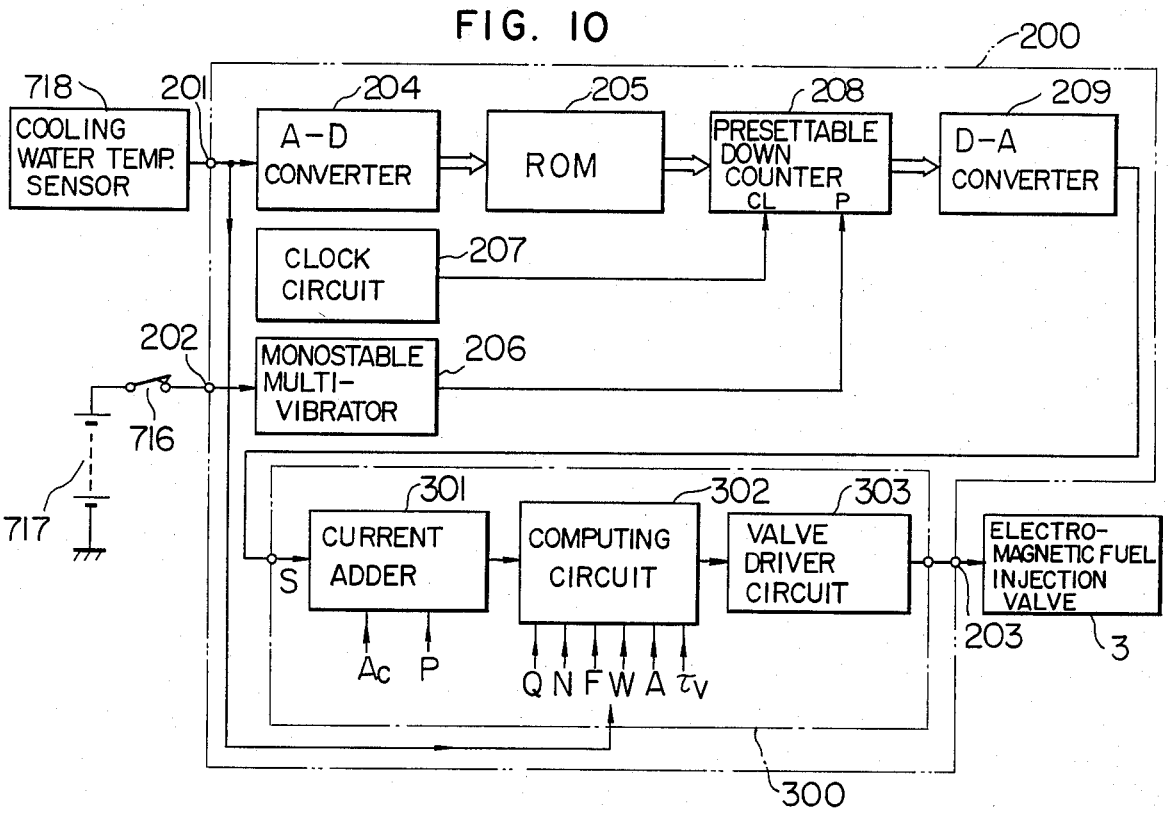
FIG. 10 is a circuit diagram showing the construction of a control circuit in an electronically controlled fuel injection system (EFI) forming a fifth embodiment of the invention.

FIG. 10 shows a control circuit in a fifth embodiment of the invention which is applied to an electronically controlled fuel injection system (hereinafter referred to as an EFI) of a fuel supply system. Numeral 718 designates a cooling water temperature sensor of the same type as the fuel temperature sensor 5' in the previously described embodiments. An input terminal 201 of a control circuit 200 is connected to the output of the water temperature sensor 718. An input terminal 202 is connected to one terminal of a key switch 716 whose other terminal is connected to the positive terminal of a battery 717. An output terminal 203 is connected to an electromagnetic injection valve 3.

On the other hand, the input terminal 201 is connected to the input of an 8-bit A-D converter 204 and the input W of a computing circuit 302 in a main control circuit 300. The input terminal 202 is connected to the input of a monostable multivibrator 206. The A-D converter 204 has its binary code output connected to an ROM 205. The ROM 205 is connected to the data input of a presettable down counter 208 (hereinafter referred to as a P-counter) for generating an 8-bit output. The output of the monostable multivibrator 206 is connected to the preset (P) terminal of the P-counter 208. Numeral 207 designates a clock circuit for generating a clock pulse of a given frequency. The output of the clock circuit 207 is connected to the clock input (CL) of the P-counter 208. The 8-bit output of the P-counter 208 is connected to the input of a D-A converter 209.

The output of the D-A converter 209 is connected to the S input of a current adder 301 of the main control circuit 300. The current adder 301 converts the voltages indicative of after-start enrichment S, warm-up acceleration enrichment $A_c$ and power enrichment P to currents and adds the same together. The output of the current adder 301 is connected to the input of the computing circuit 302. The computing circuit 302 receives the signal from the current adder 301 as well as the signals indicative of intake air quantity Q, engine speed N, feedback correction value F, water temperature correction W, air temperature correction A and dead injection time $\tau_v$ and performs the computation of the following equation (4) thereby generating the result as a pulse at its output $$\tau_{(4)}=Q/N\times F\times W\times A\times(1+S+A_c+P)+\tau_v \quad (4)$$

Numeral 303 designates an electromagnetic valve driver circuit by which the output of the computing circuit 302 is power amplified and outputted. The output of the electromagnetic valve driver circuit 303 is connected to the output terminal 203 of the control circuit 200. The main control circuit 300 is well known in the art. With the construction described so far, the operation of the control circuit 200 will now be described.

The analog voltage from the water temperature sensor 718 is converted to a digital quantity in binary code form by the A-D converter 204. The water temperature indicative digital quantity is used as an address for the ROM 205. The ROM 205 generates an enrichment rate corresponding to the water temperature address. The water temperature versus enrichment rate characteristic is shown in FIG. 11.

Figure 11:
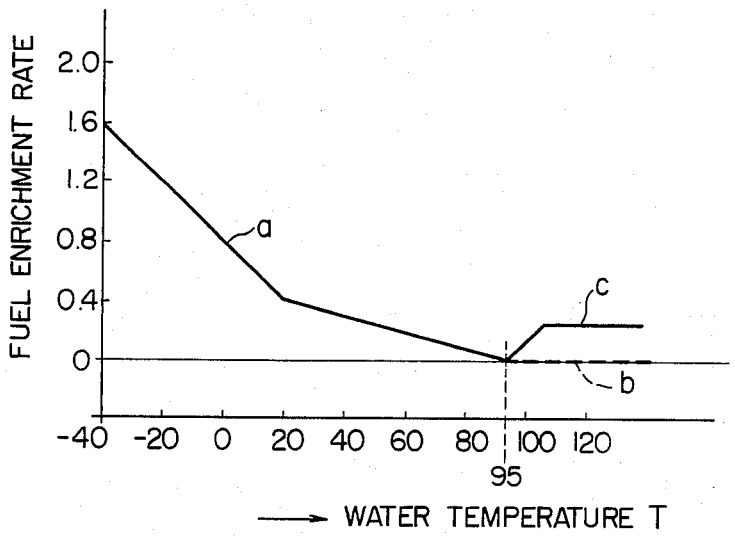
FIG. 11 is a water temperature versus fuel enrichment rate characteristic diagram for the fifth embodiment of the invention.

In FIG. 11, the abscissa represents the water temperature and the oridinate represents the enrichment rate. An enrichment rate curve a for the temperatures below about 95° C. (indicative of a high temperature condition) shows the conventional enrichments for improving the starting performance, and for the temperatures above 95° C. the enrichment rate is zero as shown by a curve b. In accordance with the invention, the characteristic shown by a curve c is used as a countermeasure for overcoming the previously mentioned difficulties. In other words, the quantity of fuel is increased at water temperatures above 95° C.

Figure 12:
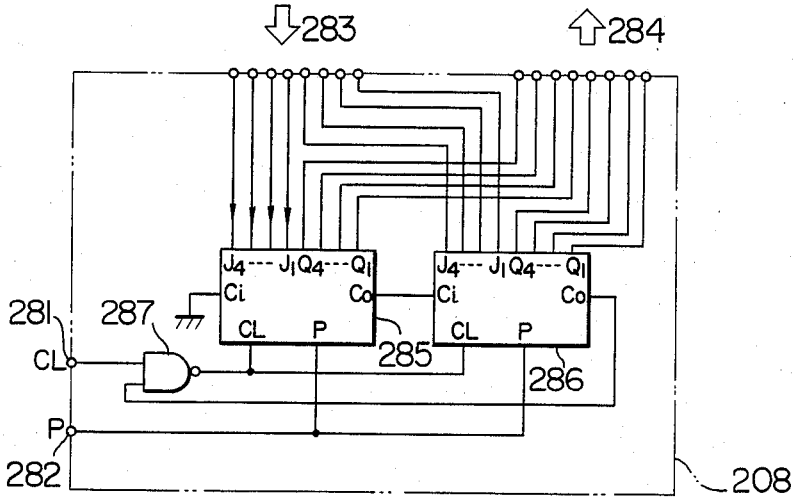
FIG. 12 is a circuit diagram showing the construction of the P-counter 208 of FIG. 10.

The circuit construction of the P-counter 208 is shown in FIG. 12. The P-counter 208 comprises two of the RCA LD 4029. The output of the clock circuit 207 is connected to an input terminal 281. The output of the monostable multivibrator 206 is connected to an input terminal 282. The enrichment rate indicative binary code output from the ROM 205 is applied to input terminals 283 which are respectively connected, in order of increasing significance, to $J_1$, $J_2$, $J_3$ and $J_4$ inputs of a counter 285 and $J_1$, $J_2$, $J_3$ and $J_4$ inputs of a counter 286. Output terminals 284 supply an 8-bit binary code output to the D-A converter 209 and are respectively connected, in order of increasing significance, to $Q_1$, $Q_2$, $Q_3$ and $Q_4$ outputs of the counter 285 and $Q_1$, $Q_2$, $Q_3$ and $Q_4$ outputs of the counter 286. The counter 285 has its $C_i$ terminal grounded and its $C_o$ terminal connected to the $C_i$ terminal of the counter 286. The counter 286 has its $C_o$ terminal connected to one input of a NAND gate 287. The other end of the NAND gate 287 is connected to the input terminal 281. The output of the NAND gate 287 is connected to the clock input (CL) of the counters 285 and 286, respectively.

With the construction described above, the operation of the P-counter 208 is as follows. The digital quantity from the ROM 205 is read into the counters 285 and 286 in response to the output pulse of the monostable multivibrator 206. Each of the counters 285 and 286 counts down in response to the clock pulses from the clock circuit 207. As soon as the output becomes zero, the carry output $C_o$ of the counter 286 goes to "0" so that the NAND gate 287 stops the delivery of clock pulses and always generates a "1" at its output. As a result, the counters 285 and 286 interrupt the counting operation until the next preset input is applied. The frequency of the clock pulses is selected so that the enrichment rates preprogrammed into the ROM 205 are each decreased at the rate of 0.03/sec.

In short, if the water temperature is 20° C., for example, the corresponding enrichment rate of 0.4 is obtained from FIG. 11. When the closed key switch 716 is opened, the value corresponding to 0.4 is read into the P-counter 208 and the value is counted down at the rate of 0.03/second. The counting is stopped when the output of the P-counter 208 becomes zero.

The D-A converter 209 comprises an R-2R type ladder network and the momentarily varying binary code output from the P-counter 208 is converted to an analog voltage and applied to the S input of the current adder 301 in the main control circuit 300. As mentioned previously, the main control circuit 300 performs the computation of the equation (1) and controls the electromagnetic injection valve 3.

Also, if the water temperature is higher than 95° C., e.g., 100° C. when the engine is started, the quantity of fuel is increased in correspondence to an enrichment rate of 0.1 as mentioned previously.

While, in the embodiment described above, the main control circuit 300 is an analog computational control circuit, if a microcomputer is used, the A-D converter 204, the ROM 205 and the clock circuit 207 may be used as the A-D converter, ROM and clock circuit of the microcomputer. Also, it should be apparent that the P-counter can be operated in accordance with a program and the D-A converter can be eliminated.

Further, where the rate of fuel enrichment (enrichment ratio) is decreased with time and the fuel enrichment rate is reduced to zero in a given period of time, the given time may be one corresponding to the degree of the fuel temperature or the cooling water temperature.

From the foregoing description it will be seen that when the engine is started again under high temperature conditions, the quantity of fuel is increased in a given manner during a given period of time after the engine start, thereby providing the proper air-fuel ratio mixtures and improving the restarting performance and the stability of idling operation after the starting.

We claim:

1. A fuel injection system for internal combustion engines comprising:

sensor means for detecting the temperature of at least one of fuel and cooling water in an engine;

means for supplying gasoline fuel to said engine; and fuel delivery control means for increasing the quantity of fuel supplied by said fuel supply means when said temperature detected by said temperature sensor means is higher than 40° C. to compensate for a decrease in fuel supplied caused by fuel vaporization, wherein said fuel supply means comprises fuel injection valve means, and where said fuel delivery control means comprises a pressure regulator including a first diaphragm chamber for receiving negative pressure in an intake pipe of said engine or atmospheric pressure and a second diaphragm chamber separated from said first diaphragm chamber by a diaphragm for receiving fuel in a fuel supply passage, and negative pressure change-over means for selectively introducing said intake pipe negative pressure and said atmospheric pressure into said first diaphragm chamber of said pressure regulator, whereby said intake pipe negative pressure is introduced into said first diaphragm chamber when the fuel temperature detected by said temperature sensor means is lower than said predetermined value and said atmospheric pressure is introduced into said first diaphragm chamber when said fuel temperature is higher than said predetermined value, thereby injecting the fuel under a high pressure when said fuel temperature is high.

2. A fuel injection system for internal combustion engines comprising:

sensor means for detecting the temperature of at least one of fuel and cooling water in an engine;

means for supplying gasoline fuel to said engine; and fuel delivery control means for increasing the quantity of fuel supplied by said fuel supply means when said temperature detected by said temperature sensor means is higher than 40° C. to compensate for a decrease in fuel supplied caused by fuel vaporization, said fuel delivery control means comprises a control circuit for comparing the temperature detected by said temperature sensor means with a predetermined reference value at the start of said engine and for generating a control signal to increase the quantity of fuel supply for a predetermined period of time from the start of said engine when said detected temperature is higher than said predetermined reference value; and fuel metering means responsive to said control signal to increase the quantity of fuel supplied to said engine over an ordinary preset quantity, wherein said fuel metering means comprises an electromagnetic on-off valve for controlling the opening and closing of an atmospheric pressure side opening of an air bleed in a slow circuit for supplying the fuel in a float chamber to a carburetor downstream of a throttle valve through an idle port, whereby in response to said control signal said air bleed is closed for a predetermined period of time to increase the quantity of fuel supplied and thereafter said air bleed is opened to adjust said fuel supply quantity to said ordinary preset supply quantity.

3. A fuel injection system for internal combustion engines of the type wherein the pressure of fuel forced to a fuel supply passage is regulated by a pressure regulator and injected into an intake pipe of an engine through fuel injection valve means, comprising:

A pressure regulator including a first diaphragm chamber for receiving intake pipe negative pressure or atmospheric pressure and a second diaphragm chamber separated from said first diaphragm chamber by a diaphragm for receiving the fuel in a fuel supply passage for regulating a differential pressure between said diaphragm chambers to a predetermined value;

temperature sensor means for detecting the temperature of the fuel in said fuel supply passage;

negative pressure change-over means for selectively introducing said intake pipe negative pressure and said atmospheric pressure into said first diaphragm chamber, whereby said intake pipe negative pressure is introduced into said first diaphragm chamber when said fuel temperature is lower than a predetermined value, and said atmospheric pressure is introduced into said first diaphragm chamber when said fuel temperature is higher than said predetermined value thereby injecting the fuel under a high pressure when said fuel temperature is high.

* * * * *